United States Patent [19]

Klingler et al.

[11] 4,031,719

[45] June 28, 1977

[54] LOCK-PROTECTIVE DEVICE

[76] Inventors: Lawrence R. Klingler, 124 - 20th St., Huntington Beach, Calif. 92648; Daniel E. Shook, 2543 Orange St., Costa Mesa, Calif. 92626

[22] Filed: Oct. 8, 1976

[21] Appl. No.: 730,733

[52] U.S. Cl. ..... 70/56; 70/128; 292/57; 292/148

[51] Int. Cl.[2] ..... E05B 67/38; E05C 5/02

[58] Field of Search ..... 70/54, 55, 56, 128, 70/129, 81, 83, 90, 417, 418; 292/57, 58, 281

[56] References Cited

UNITED STATES PATENTS

| | | | |
|---|---|---|---|
| 708,892 | 9/1902 | Long | 70/128 |
| 1,248,293 | 11/1917 | Ellington | 70/56 |
| 3,334,933 | 8/1967 | Ehlers | 292/14 B |
| 3,953,062 | 4/1976 | Maston | 292/57 |

*Primary Examiner*—Robert L. Wolfe
*Attorney, Agent, or Firm*—Francis X. LoJacono

[57] ABSTRACT

A lock-protective device designed to be used with various well known garage-door-locking units wherein the units include a sliding bolt, adapted to be slidably secured to the lock housing of the unit by a padlock, the present lock-protective device comprising a protective plate having a front wall and an integrally formed rear wall which is bent over to form a support keeper that is received over the locking bolt and allows the front wall to cover the padlock. There is included a lock strut positioned between the front and rear wall members, said strut having an aperture therein to correspond to the opening in the existing ear of the lock housing, whereby the padlock arm is received through both openings to prevent removal of the lock-protective device therefrom.

4 Claims, 4 Drawing Figures

LOCK-PROTECTIVE DEVICE

BACKGROUND

1. Field of the Invention

This invention relates generally to a safety, lock-protective device and, more particularly, to a device to protect padlocks and related garage-door-locking units.

2. Description of the Prior Art

As is well known in the art, various problems and difficulties are encountered in providing suitable means for preventing breaking and entering into storage facilities such as commercial warehouses and residential garages that have the well known type of outside locking units wherein a sliding bolt is employed to secure the door from movement.

Generally, these locking units are formed by a support housing defined by a metal plate adapted to be secured to the garage door adjacent the framing around the opening of the garage. The plate is provided with a pair of ears in which the bolt can slide to the right or left. The bolt is formed having a U-shaped member received over a locking ear member to which the padlock is secured.

This arrangement is sufficient to keep out most unauthorized individuals. However, those individuals who are determined to illegally enter such areas can very readily break the padlock and enter at will.

Various professional methods can be employed in removing a padlock from the locking unit, one being hitting it with a hammer, another—which is very widely used—is the employing of a bolt cutter and cutting the padlock arm.

Thus, with the addition of the present invention the following description thereof will illustrate how such problems are alleviated.

SUMMARY

The present invention comprises a protective plate having an enlarged forward wall and an integrally formed rear wall which is defined by bending the upper end of the plate downwardly, thereby providing an inverted, substantially V-shaped mounting portion. That is, the plate is so arranged as to be received over the slidable locking bolt of the garage-door lock unit.

Laterally positioned between the forward wall and the rear wall of the protective plate is a strut member secured thereto or integrally form therewith, having an aperture disposed therein to align with the aperture found in the locking ear of the garage-locking unit.

Thus, when the bolt is positioned to extend into the adjacent frame of the garage opening and the locking tongue of the bolt is mounted over the locking ear, the protective-locking device is mounted over the bolt so that the rear wall is positioned behind the bolt, and the front wall is arranged to cover the padlock when the padlock arm is received in both the aligned opening of the strut and the locking ear member which abut each other in a side-to-side manner.

Further, the configuration of the rear wall includes a downwardly extended leg member which aids in preventing various cutting instruments from reaching the padlock or lock ear.

The leg member will be formed on the right side of the rear wall when a left-hand locking unit is employed—that is, a locking unit having a bolt that is received in the left side of the garage framework—while a unit that is designed to have its bolt received in the right side of the framework will require protective-lock device wherein the downwardly depending leg member is positioned to the left portion of the rear wall.

Hence, when the protective lock device is used, the exposed side thereof is provided with the depending leg member so that access to the padlock is prevented. Access from the opposite side is prevented by the close proximity thereof to the garage-door frame.

OBJECTS AND ADVANTAGES OF THE INVENTION

The present invention has for an important object a provision wherein padlocks and the like can be protected from vandalism or deliberate destruction in order to provide illegal entry to a given area.

Another object of the invention is to provide a protective-lock device for garage-door-lock units using padlocks therewith.

It is another object of the invention to provide a protective-lock device that prevents various tools such as metal saws, bolt cutters, etc., from being used to engage the lock being protected by the present invention.

Still another object of the present invention is to provide a protective-lock device that is adaptable to most garage doors having a left or right-hand locking unit.

It is still another object of the present invention to provide a device of this character that has no moving parts, and is simple and rugged in construction, wherein the device comprises a single metal plate having a strut member which is adapted to be connected to the locking unit by the same padlock that is used to lock the door.

It is a further object of the invention to provide a device of this type that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed and we contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
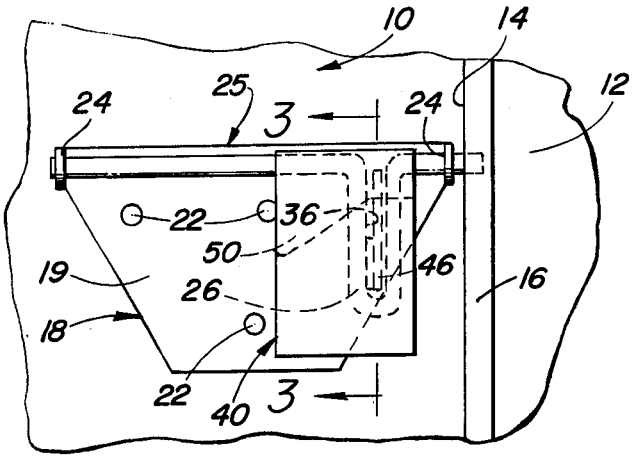
FIG. 1 is an elevational view of the present invention shown attached to a garage door, wherein the locking unit is arranged as a right-hand unit engaging the frame of the garage opening.
Figure 4:
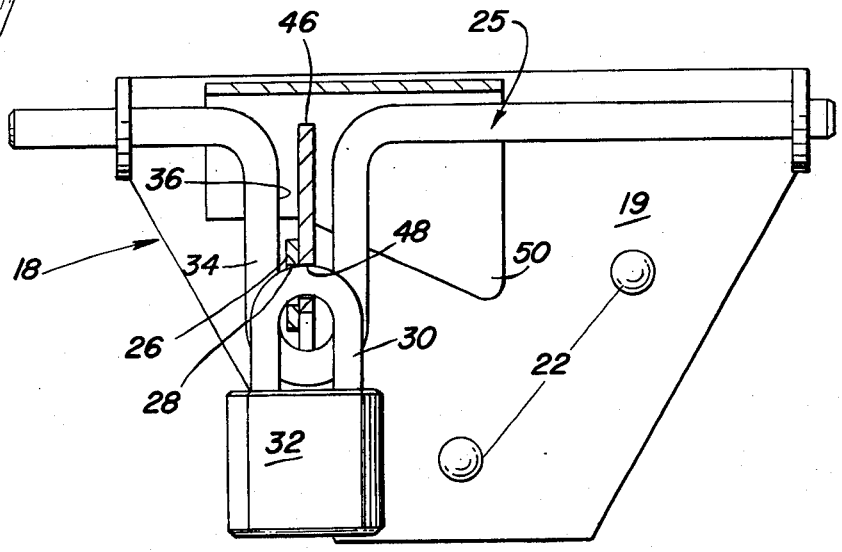
FIG. 4 is a elevational view of a garage-door-locking unit formed with a left-hand arrangement having the lock-protective device broken away to illustrate the position of the rear wall and strut member with respect to the bolt member.

Referring more particularly to FIG. 1, there is shown a portion of a garage door, generally indicated at 10, the garage door being movably attached in any well known manner to a garage 12, or the like, having an opening 14 including a frame structure 16. Mounted to the door is a well known garage-door-locking unit, generally designated at 18, having a mounting plate 20 which is secured to the door 10 by suitable bolts 22. Said mounting plate 20 includes a pair of outwardly turned bolt-support ears 24 disposed generally as shown at the upper, opposite ends of plate 19. The bolt-support ears are provided with holes therein to receive a slidable lock bolt, indicated generally at 25. Included as part of mounting plate 19 and affixed thereto is laterally extending lock-ear member 26 provided with an aperture 28 through which the locking arm 30 of the padlock 32 is received, as seen in FIG. 4. This arm is positioned below the locking bolt 25 and can be located either to the left side of the plate 19 or to the right side of the plate, depending on which side of the garage door the locking unit is to be mounted as previously described.

Figure 3:
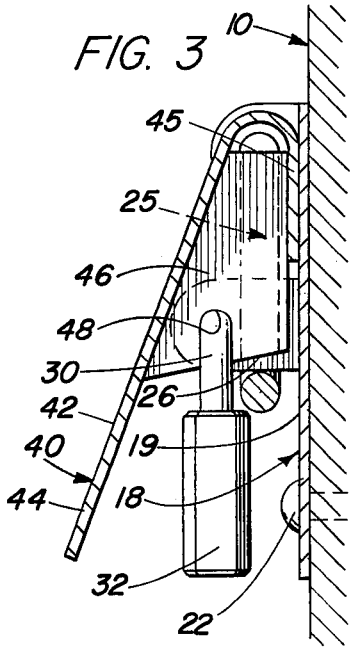
FIG. 3 is an enlarged cross-sectional view taken substantially along line 3—3 of FIG. 1.
Figure 2:
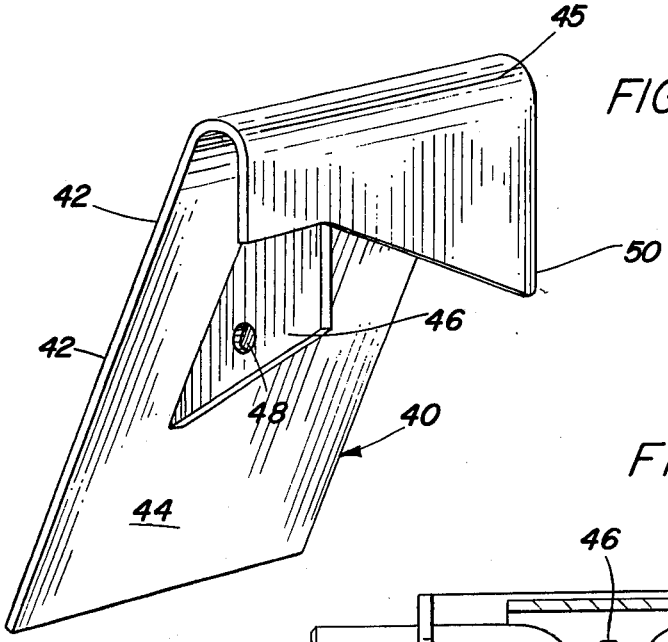
FIG. 2 is a perspective view of the protective-lock device and illustrated as being of the type used for right-hand locking units.

Please note that the locking unit 18, as illustrated in FIGS. 1 through 3, is shown as a right-hand unit having lock ear 26 located to the right side of plate 18; and the unit shown in FIG. 4 is illustrated as being a left-hand unit, wherein the lock ear 26 is positioned on the left side of plate 19.

To provide the necessary locking arrangement, the bolt 25 is so designed as to have a locking tongue 34 formed with a vertical, elongated slot 36 in which lock ear 26 is received therethrough, so as to allow aperture 28 to be positioned outwardly therefrom. It should be kept in mind that other suitable tongue arrangements can be provided; but the one herein shown is formed in conjunction with the single locking bolt 25 by forming a laterally extended U-shaped member, which herein defines tongue 34.

Normally, when using the existing locking unit by itself, the padlock arm is fully exposed so as to be readily damaged. Thus, to gain entry to a locked area having such a unit thereon, one merely has to cut arm 30 which can be done by bolt cutters or metal saw blades.

Accordingly, to prevent this from happening, the present invention is employed. The lock-protective device, indicated generally at 40, comprises an elongated, narrow plate 42, wherein the device is defined by a front wall 44 having its upper end bent about itself, forming a rear, shorter wall 45 whereby a somewhat inverted V is defined thereby. The rear wall provides a support keeper whereby the rear wall is placed behind sliding bolt 25 disposed between bolt 25 and mounting plate 19, as seen in FIGS. 3 and 4.

Further the lock-protective device includes a vertical strut member 46 having a substantially triangular configuration so as to be affixed between the front wall 44 and the rear wall 45. Said strut can be welded to each wall and is formed as an integral part thereof. An aperture 48 is disposed within strut 46 whereby both apertures 28 and 48 are aligned when strut 46 is positioned within slot 36 of tongue 34, as seen in FIGS. 3 and 4. Strut 46 is also positioned adjacent ear 26. Thus, the protective-lock device 40, once so arranged on the garage-locking unit with padlock 32 mounted thereto, totally prevents access to padlock 32, arm 30, or ear 26.

In addition, the rear wall 45 of plate 42 is designed with a depending leg member 50 which will be located on the free, open side of the device, whereby a further limiting access means is provided.

Hence, as can be seen in FIG. 1, the right side of the unit is protected by framework 16 of the garage 12; and the left side thereof is protected by the depending leg member 50.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and we do not wish to be restricted to the specific form shown or uses mentioned, except as defined in the accompanying claims.

We claim:

1. A lock-protective device for garage-door locking units and similar locking units having a mounting plate, a slidable locking bolt, and locking ear, and including the use of various styles of padlocks having a locking arm, wherein the device comprises:
   - an elongated cover plate having a front cover wall and a rear wall wherein each wall is interconnected along its upper portion;
   - a support keeper fromed by said rear wall, said keeper being arranged to be received over said sliding bolt, and disposed between said sliding bolt and said mounting plate of said locking unit; and
   - a strut member positioned between said front and rear wall and secured thereto, said strut having an aperture therein to receive said locking arm of said padlock.

2. A lock-protective device as recited in claim 1, wherein said front and rear walls are integrally formed as a single member, whereby said rear wall is bent downwardly and inclined outwardly from said front wall, forming a substantially inverted V-shaped configuration, wherein said front wall covers the padlock, and said rear wall covers said locking ear to prevent access thereto.

3. A lock-protective device as recited in claim 2, wherein said rear wall thereof includes a depending leg member formed along one side thereof.

4. A lock-protective device as recited in claim 3, wherein said strut member is affixed between said front and rear walls so as to be positioned adjacent said locking ear of said locking unit in a side-to-side relationship, wherein a hole disposed in said ear is aligned with said aperture of said strut member, whereby said locking arm of said padlock is received therethrough, providing a locking relationship therebetween.

* * * * *